US008281826B2

(12) United States Patent
Uelmen et al.

(10) Patent No.: US 8,281,826 B2
(45) Date of Patent: Oct. 9, 2012

(54) SHARP EDGED KNIFE STOP

(75) Inventors: Robert L. Uelmen, Tarpon Springs, FL (US); Aaron J. Adent, Tampa, FL (US)

(73) Assignee: Iggesund Tools AB, Iggesund (SE)

( * ) Notice: Subject to any disclaimer, the term of this patent is extended or adjusted under 35 U.S.C. 154(b) by 165 days.

(21) Appl. No.: 12/681,649

(22) PCT Filed: Oct. 22, 2008

(86) PCT No.: PCT/US2008/080818

§ 371 (c)(1),
(2), (4) Date: Apr. 5, 2010

(87) PCT Pub. No.: WO2009/055488

PCT Pub. Date: Apr. 30, 2009

(65) Prior Publication Data

US 2010/0218850 A1 Sep. 2, 2010

Related U.S. Application Data

(60) Provisional application No. 60/981,652, filed on Oct. 22, 2007.

(51) Int. Cl.
*B27C 1/00* (2006.01)

(52) U.S. Cl. ..... 144/162.1; 144/174; 144/176; 144/218; 144/230

(58) Field of Classification Search ..... 144/162.1, 144/172–174, 176, 218, 220, 230, 241, 117.1; 407/43, 70, 113

See application file for complete search history.

(56) References Cited

U.S. PATENT DOCUMENTS

| | | | | |
|---|---|---|---|---|
| 3,542,302 | A * | 11/1970 | Salzmann, Jr. | 241/298 |
| 4,047,670 | A * | 9/1977 | Svensson | 241/92 |
| 4,887,772 | A * | 12/1989 | Robinson et al. | 241/92 |
| 5,129,437 | A * | 7/1992 | Nettles et al. | 144/176 |
| 5,820,042 | A * | 10/1998 | Robison | 241/92 |
| 7,159,626 | B2 * | 1/2007 | Biller et al. | 144/176 |
| 2005/0081956 | A1 * | 4/2005 | Haapasalo | 144/176 |

* cited by examiner

*Primary Examiner* — Bena Miller

(74) *Attorney, Agent, or Firm* — Fitzpatrick, Cella, Harper & Scinto

(57) ABSTRACT

A sharp edged knife stop can secure the position of knife blades in a cutting or chipping system and prevent the separation of knife blades. The sharp edged knife stops can also assist in the cutting or chipping and lower the amount of debris build up that would occur with the use of traditional knife stops. The sharp edged knife stop has the same inclination angle as the knife blades and the same difference in knife edge height as the knife blades above that of a retaining ring height.

16 Claims, 10 Drawing Sheets

SHARP EDGED KNIFE STOP

TECHNICAL FIELD

The present invention relates generally to material chopping devices, such as disk type wood chippers. In particular, the invention relates to a knife assembly, for use in material chopping devices, in which the knife holding assembly has sharp edged knife stops, and the use thereof. The invention also relates to a knife stop which has a cutting edge and prevents a plurality of blades in a knife pocket from separating.

BACKGROUND OF THE INVENTION

Wood is an important natural resource that is used in many of today's modern products. Within the forest industry, trees are harvested, cut into logs, and then undergo various processes to transform the logs into finished products. For example, in the pulp or oriented-strand board industries, the logs are passed through a machine which turns the solid log into chips or wafers. Such machines are typically referred to as chippers, which may be in a disc or a drum form, and waferizers or stranders, which can also take a number of forms.

Within the sawmill industry, it is common for logs or semi-manufactured lumber to be passed through machines which chip away the outside portions of the material being processed to form rough lumber and a multitude of wood chips. Such machines are commonly referred to as chipper canters, chipper edgers and chipper slabbers, each of which can take a variety of different forms. Typically, this rough lumber is then processed by planers to yield finished lumber having a smooth cut surface and wood shavings as a by-product.

As in discussed in U.S. Pat. No. 7,159,626 issued Jan. 9, 2007 to Iggesund Tools AB, planers, chippers, waferizers and other such wood processing machines typically carry a number of knives mounted to a moving base, such as, for example, a rotating disc or drum. The wood being processed is moved into the path of the rotating knives and the blade contacts the wood at a depth and orientation that results in the formation of wood chips, shavings, wafers, or strands. With chipper edgers, chipper canters, planers, or other similar wood finishing devices, the knives are also appropriately positioned to result in the formation of a cut or planed surface on the wood being worked. With veneer lathes, however, the knife remains relatively stationary while the log, rotated about its axis, is engaged by the knife.

A typical rotary disk type chipper is described in detail in U.S. Pat. No. 5,129,437 to Nettles et al. In the chipper of this configuration, as shown in FIG. 2, logs are fed against a rotating disk which carries a number of radially disposed knives clamped between a main portion of the disk and respective segmental or pie-wedge shaped knife holders.

Common to all the aforementioned machines is that the repetitive contact between the cutting edge of the knife and the wood causes the cutting edge to wear and become dull over time. When the knife becomes too dull, it ceases to cut the wood cleanly and effectively. For example, in chippers, waferizers, and veneer lathes, a dull knife results in chips, wafers, or veneer of reduced quality and/or inconsistent size. In chipper canters, edgers, slabbers, or other like machines where rough or finished lumber is produced, knife sharpness influences the quality and accuracy of the finish of the wood being processed.

Traditionally, the method for maintaining knives sharp in the machines has been to remove the knife from the knife clamping assembly within the machine. This type of knife, called a ground knife, is sharpened by regrinding the knife blade, and then replacing the knife in the clamping assembly. However, this approach suffers from a number of known limitations. During each regrinding, portions of the knife must be ground away to create a fresh sharp cutting edge. This regrinding results in a change in size of the blade that if left unadjusted, would result in an altered location of the cutting edge after each regrinding. Specifically, the position of the cutting edge may be altered relative to the features that position the knife in the clamping assembly.

Ground knives are designed to be large knives that are fixed in place by a combination of clamping components. Ground knives are also defined by their large overall size or width. FIG. 1 is a cut-out depiction of a ground knife blade holding assembly. The ground knife 2 is held down by a top plate 12 which is secured to a base plate 11 of the knife holding assembly. A sharp cutting edge is maintained on the ground knife 2 by grinding the edge of the knife blade when it becomes dull. The overall width of the knife can be maintained by either adding molten material or by a mechanical means, such as an adjustment screw or bolt on the back of the knife.

The position of the cutting edge can be displaced from its desired and intended location relative to the wood being worked or important associate components within the machine such as anvils and guide plates. Unless the position of the knife is continually adjusted in the clamping assembly, which is difficult to do accurately and is also time consuming, the performance achieved with the machine is degraded, sometimes to unacceptable levels. For example, with chipper canters, a precise positioning of the face or finishing knives relative to the wood being processed is a requirement for an accurate cut surface. Relatively small deviations in position can have a measurable impact on the quality of the finish achieved.

Another limitation of this approach is that the grinding may not be sufficiently precise. Equipment utilized within wood processing facilities is often such that accurate form (shape and angle) of the cutting edge cannot be maintained. Furthermore, during the on-site regrinding, the knives are sometimes damaged, whether through overheating or other grinding process irregularities. This can reduce the quality of the cutting edge, cause the knife to wear faster, and degrade performance. Similarly, deviations in the form of the cutting edge can also result in a reduction in performance.

To overcome such problems, it has become common to use disposable blades, most often of a reversible, or double-edged, design. Such a knife is shown, for example, in U.S. Pat. No. 4,047,670 issued Sep. 13, 1977 to Aktiebolaget Iggesunds Bruk. The disclosed knife is essentially a planar, elongate body with one cutting edge running along one side of the elongate body and a second cutting edge running along the other. The knife is mounted in a knife clamping assembly that is sized and shaped to secure the blade during operation and allow for easy and rapid knife changes. In use, when the first cutting edge becomes dull, the knife is reversed and the second cutting edge is presented and used. When that cutting edge has also become worn, the knife is disposed of and replaced with a new one having two more fresh cutting edges.

Disposable knives are typically double-edged knives that are substantially smaller in overall size (width) than ground knives. As disposable knives are smaller in size and have two edges, they rely on an interacting knife and clamp assembly to fix them in place. An example of a disposable knife holding assembly is shown in FIG. 2. The disposable knife blade 20 is held between a knife holding top plate 24 and a knife holding base plate 21. The knife holding top plate 24 and the knife holding base plate 21 are then secured to the disposable knife holding assembly base plate 11 by a screw, bolt, or other fastening means.

With disposable knife designs, the problems relating to the grinding of the knife are eliminated because the knives are not reground. The dimensions and form of the knife, controlled by the knife manufacturer, remain unaltered between changes. There is also a certain gain in efficiency, because the smaller lightweight disposable blades, typically of higher quality materials and manufacture, allow for increased run times between changes. Also, because of the ease of replacing and rotating the knives, machine stoppage time for knife maintenance is further reduced.

Another problem that affects knives used in many types of wood processing machines is the difficulty in securing the knives in the clamping assemblies under the action of the cutting forces. The blades must also be secured against movement in the radial direction. The problem is most prevalent with disposable blade designs where the requirement for cost effectiveness and competitiveness mandates that the blades be compact and lightweight.

In many chipping systems, ground knife holding assemblies and disposable knife holding assemblies are both held in place by a clamp, which is disposed on top of the knife. As such, when the piece of material being chipped contacts the blade, the blade is restrained from separating from the base plate 11 of the knife holding assembly by the clamp, as depicted in FIGS. 1 and 2. Compact blades, however, are often difficult to secure in the clamping assembly such that they can resist the various types of loads encountered across the different types of applications. Chipping applications, for example, involve significant cutting forces directed towards the underside of the knife, whereas with planers or waferizers, these cutting forces are relatively low. With chipper edgers and chipper canters, the face of finishing knives can often encounter significant loads directed to the topside of the cutting edge.

Devices for limiting the radial movement of disposable knife blades are commonly known as knife stops. Knife stops for disposable knives, hereafter referred to as traditional knife stops, have usually been designed in the tradition of the retaining devices for ground knives, by keeping the height of the traditional knife stop significantly below the knife cutting plane. The top surface of a traditional knife stop is essentially even with the plane of the rotating element. Examples of traditional knife stops are shown in FIG. 3 and FIG. 4. The traditional knife stops limit radial movement of the knife blades to prevent multiple blades from separating from each other in a given knife pocket.

The traditional knife stops 30 and 31 prevent radial movement of the blades 36. The inner traditional knife stop 30, however, must be positioned inside of a wall of an inner retaining ring 32. As such, a gap is formed between the wall of the inner retaining ring 32 and the end of the knife blade 36 closest to the wall of the inner retaining ring 32. The traditional knife stop can be attached directly to the knife blade holding assembly. In order to directly attach the traditional knife stop, however, the knife blade holding assembly must be removed from the retaining rings. Sometimes, a special recess 37 must be created in the retaining rings, in order to accommodate the traditional knife stop. As such, utilizing traditional knife stops can increase the amount of time required to change a blade and to adjust the knife stop.

The traditional knife stops 30 and 31 also create an extra surface and/or a gap, as shown near the inner retaining ring 32, which rotates with the rest of the knife assembly. The traditional knife stops 30 and 31, however, are not designed to help move chipped material away from the cutting edge of the blade. When material is chipped away by the knife blade 36, debris is caught in the gap near the retaining ring, forming an inner debris buildup area 34.

Likewise, in the area where the of the knife blade 36 is closest to the wall of outer retaining ring 33, an outer debris buildup area 35 is formed near the special recess 37 created in the outer retaining ring 33 in order to accommodate the outer traditional knife stop 31. The debris built up in debris build up areas 34 and 35 can lower the effectiveness of the entire chipping system by decreasing the effectiveness of the chipping edge of the blade. The debris accumulates between the knife and the knife stop. Such accumulated debris is difficult to remove. When changing a knife blade, a significant portion of the machine downtime for changing the blade is spent removing debris that is packed in between the knife and the knife stop. As these knives are utilized in high production machines, the amount of downtime should be minimized.

As shown in FIG. 4, the traditional knife stop 30 can be attached to the side of the knife blade holding assembly. As such, the traditional knife stop 30 prevents the blades 36 from separating from each other, so that no gaps are created along the cutting edge, while the knife clamp 42 prevents the blades from separating from the base of the rotating member. The knife clamp is fastened down into the rest of the knife holding assembly by bolts, screws or other fastening means. The traditional knife stop 30 can be secured to either the knife clamp 42 or to the base of the knife holding assembly.

The blades are inclined so that the cutting edge of the blades is above the surface of the rotating member. The top of the traditional knife stop 30 is below the surface of the cutting plane 48 of the rotating member. The traditional knife stop 30 does not have a cutting edge and, therefore, the top of the traditional knife stop is usually no higher than the top surface of the cutting plane 48 of the rotating member.

As shown in overhead view of the knife clamp in FIG. 5, the knife clamp 42 is secured into the base, on the top of knife blade 36, by a number of fasteners 52. The traditional knife stop 30 prevents the knife blade from moving laterally. The traditional knife stop 30, however, also creates a gap 53 between the retaining ring 57 and the knife clamp 42. As material is chipped by the knife blade, debris builds up in this gap because the forward edge 47 of the traditional knife stop 30 is not designed to facilitate the flow of chipped material away from the knife blade. This debris must be removed when blades are changed or rotated. A significant amount of time during blade replacement or rotation operations is now spent removing debris. If this time can be minimized or eliminated, the efficiency and running time of high production chipping and cutting machines can be greatly increased.

Still another particular problem that affects knife designs is the unsymmetrical nature of the loads distributed along the knife length. Wood is not a homogeneous material. Sometimes, the wood being processed will exert a greater force against one localized area of the cutting edge than against the remainder of the blade. The most common reason for this is that the cutting edge strikes a knot or some other irregularity in the wood. In some arrangements, one or both ends of the knife may be utilized to produce a side cut. This can add to the non-symmetric nature of the loads encountered by the knife. As such, the quality of the end product from chipping and cutting machines is dependent on the accuracy of position of the knife cutting edge relative to the machine achieved during the initial installation. The ability to maintain the position of the knives when subjected to load also affects the quality of the end product. The greater the accuracy of the knife position, in general, the better the quality of the wood working results.

In most knife arrangements, knives are inserted into a clamping assembly by hand. Under such circumstances, precise positioning may be difficult, simply because the required precision may be greater than is possible in a manual operation. In many cases, the knives are changed in situations that are physically awkward for the person changing the knife. Depending on the circumstances, the person may need to reach overhead or around cumbersome components to perform the change. This renders precise positioning even more difficult.

When a cutting system utilizes a disposable knife assembly, it is common to place a plurality of knives in each knife pocket. The knife clamp 42, as shown in an overhead view of a knife blade holding assembly illustrated in FIG. 6, can be used to hold multiple knife blades 36 in place in a given knife pocket. The blades run the length of the exposed knife edge cutting area 60. When chipping material from a log, the center of the exposed knife edge is utilized more than the outer portions of the knife edge. This results in there being an area of high utilization 61 of the blade and two areas of low utilization 66 and 67 of the blade.

Utilizing a plurality of knives 36A-C in each knife pocket allows a cutting system operator to swap knife positions of the plurality of knives 36 distributed along the exposed knife edge cutting area 60. In disk type chipping systems, the middle portion of the knife blade is likely to have a higher level of use than the outer edges of the knife blade. As such, the high use area 61 in the middle of the knife blade is likely to produce a greater level of wear than that on the outer portions of the blades in the low use areas. The inner and outer portions of the knife 66 and 67 are not utilized as heavily as the middle of the blade and, therefore, do not wear down as quickly. Blade 36B is located entirely in the area of high utilization 61, while blades 36A and 36C may be located partially in the area of high utilization 61 and partially in the areas of low utilization 66 and 67. As such, the wear on blade 36B will be greater than the portions of blades 36A and 36C that are located in the areas of low utilization. The unevenness of the wear along these blades can be compensated for by frequently rotating the position of the blades.

When there is an area of concentrated wear, the swapping of the knife positions allows for more even use of the entire knife edge. Blade 36B, which is in the center of the high use area of the knife, will wear relatively evenly. Blades 36A and 36C, however, are located partially in the high knife use area and partially in low use areas of the knife. As such, the portions of blades 36A and 36C that are in the low use area of the knife will not be worn down as quickly as the portions of the blades in the area of high utilization.

By swapping positions of blades 36A and 36C, the portions of the blade in the low use area of the knife will be utilized in a high use area, and the wear on the blades can, therefore, be evened out. The practice of swapping of the knife positions in a pocket can maximize the economy of a disposable knife blade. The swapping of the blade positions, however, has proven to be a difficult procedure to accomplish within mill operations. Rotating the blades in order to ensure even blade wear is a time consuming operation that unnecessarily increases downtime in the chipping or cutting machine.

As an alternative to traditional knife blade stops, a knife block device may be used. Knife block devices may also be used in combination with knife stop devices. FIG. 7 is an overhead depiction of the outer end portion of a knife blade holding assembly with a knife block device 70 built into the retaining ring 73. The knife block device 70 abuts directly against the end of the knife blades 36, and operates to counter the centrifugal forces applied by the rotating element to keep the knife in place, in the same way that the traditional knife stop does. The knife block device, however, requires an even larger recess to be created in the retaining ring, as well as additional fasteners to hold the knife block in place.

Strength requirements may differ between applications or according to the type of species being processed, climatic factors, or other external variables. This imposes further restrictions on the size and shape of the knife and the surrounding clamping components since it requires that they be designed to be able to sustain the loads encountered within the relevant geometric constraints.

BRIEF SUMMARY OF THE INVENTION

Therefore, what is desired is a knife, knife stop, and/or a cooperating clamping assembly that can more efficiently utilize the knife blades and that requires less interchanging of the position of the blades. Also, the knife and clamping assembly will each preferably be designed to require less alteration of the wood processing machine holding the clamping assembly. As well, what is preferred is a knife that will lower the amount of debris buildup along the blade of the knife system.

Therefore, according to one aspect of the invention, there is a sharp edged knife stop having a knife stop cutting edge. An inclination angle of the sharp edged knife stop may match an inclination angle of a knife blade in order to form a knife holding assembly cutting edge. A profile of the sharp edged knife stop matches a profile of the blade in order to form a knife holding assembly cutting edge.

A sharp edged knife stop can be placed in the exposed cutting area of a knife holding assembly in a material processing machine, in order to limit radial movement of blades in the knife holding assembly. The sharp edged knife stop can also resist material buildup in the area between retaining ring and a knife blade by eliminating extraneous surfaces that cause this buildup. Further, the sharp edged knife stop can reduce the need to swap the knives in the pocket to better utilize the edges.

DETAILED DESCRIPTION OF DRAWINGS

Figure 8:
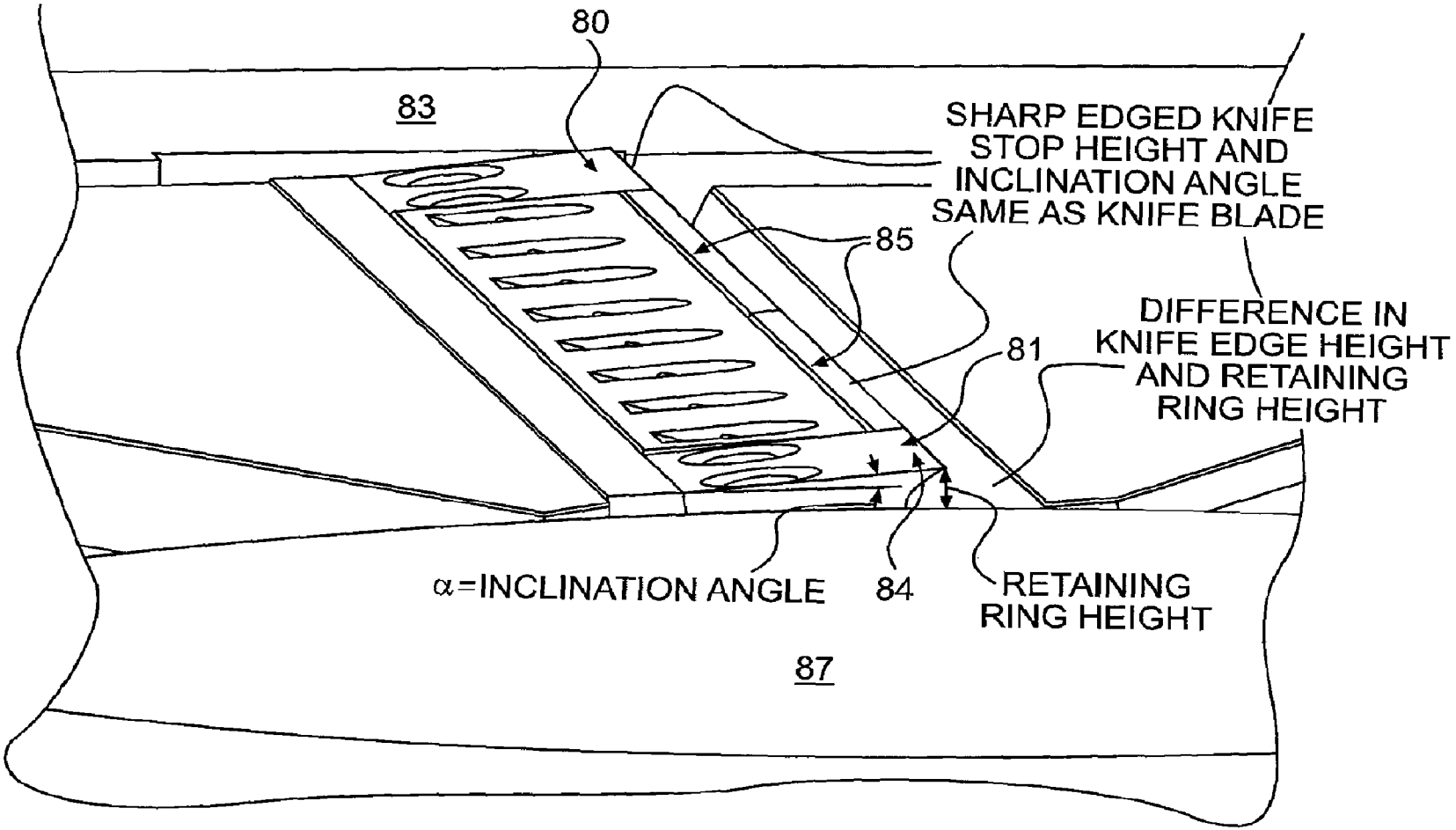
FIG. 8 is a depiction of a knife blade holding assembly with a sharp edged knife stop in a retaining ring.

The present invention eliminates the need to alter the retaining rings and improves the efficiency of blade utilization. As shown in FIG. 8, sharp edged knife stops 80 and 81 can be placed on both ends of a knife, in order to secure blades 85 positioned therebetween. As such, radial movement of the blades is prevented, so that the blades do not separate from each other. The sharp edged knife stops are placed inside of the inner and outer retaining rings 83 and 87. As such, the retaining rings do not require alteration in order to accommodate the sharp edged knife stops 80 and 81. The top surface of the retaining rings is essentially parallel with the plane of the rotating elements shown in FIG. 8.

The present invention utilizes sharp edge knife stops to decrease the need to rotate blades. The sharp edge knife stops have an edge height that is the same height as the blades 85. As such, the sharp edge knife stops 80 and 81 form part of the knife chipping or cutting edge. The sharp edge knife stops also prevent the multiple blades 85 from separating from each other in a manner similar to a traditional knife stop.

The invention covers a sharp edged knife stop that differs from previous designs in that it has a sharp cutting edge that meets up with the cutting edge of the knife. The sharp edge knife stops are an integral part of the cutting edge. The top surface of the sharp edge knife stop, as shown in FIG. 8, likewise matches up with the inclination angle of the knife. The sharp edged knife stops have same inclination angle ($\alpha$) above the cutting plane as that of the blades. As such, the sharp edged knife stops also have the same difference in height above the retaining ring as that of the knife blades. The sharp cutting edge feature of the stop provides the benefits of resisting material build up in the area between the knife edge and the knife stop, thereby minimizing or eliminating the need for mill operators to swap the knives in the pocket to better utilize the edges, and allowing the placement of the knife stop in the exposed cutting area of the chipping device.

Figure 9:
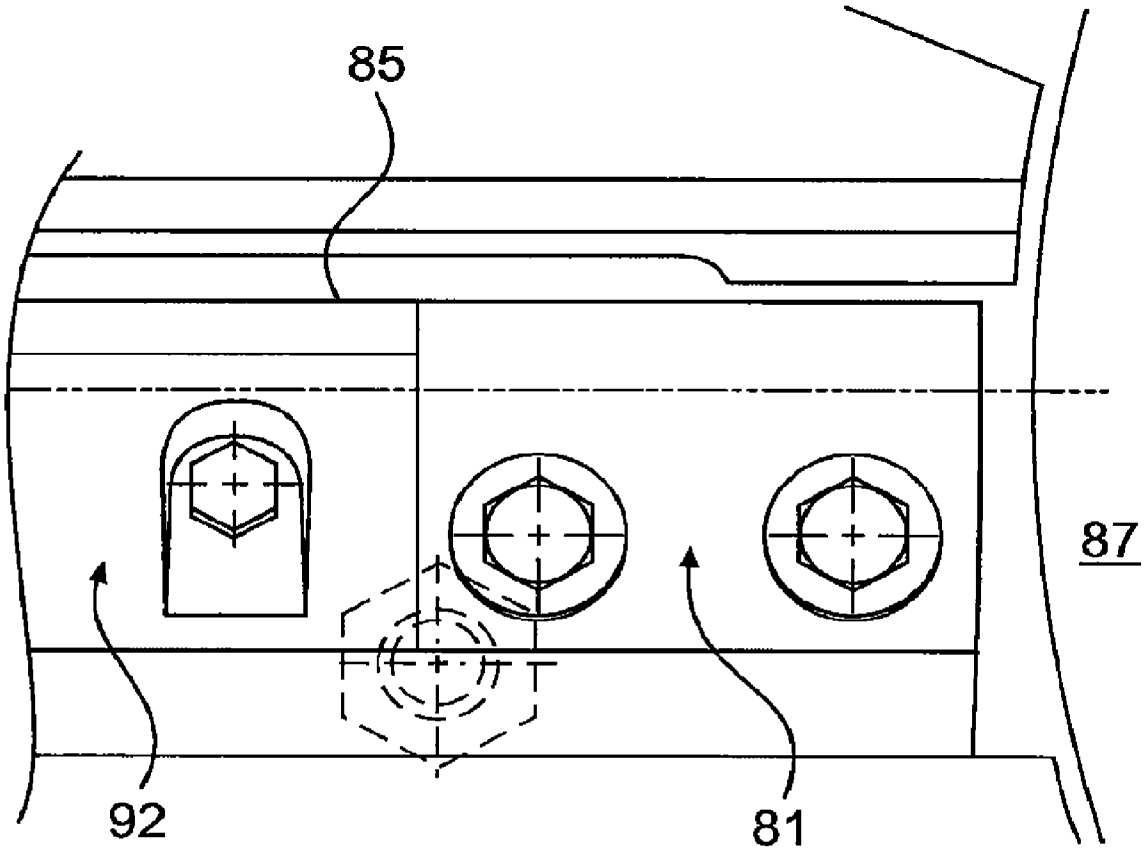
FIG. 9 is a close up overhead depiction of the inner end portion of a knife blade holding assembly with a sharp edged knife stop.

As shown in FIG. 9, the sharp edged knife stop 81 directly abuts the knife clamp 92 in order to secure the knife blade 85, in order to ensure that when multiple knife blades are used, the blades do not separate. The sharp edged knife stop 81 can be fastened down into the assembly in a manner substantially similar to that of the knife clamp 92. As such, there is no need to alter the retaining ring 87. The knife stop is depicted as having two fasteners, although the invention is not so limited. The knife stop may be secured using only a single fastener, or with a larger number of fasteners.

Figure 1:
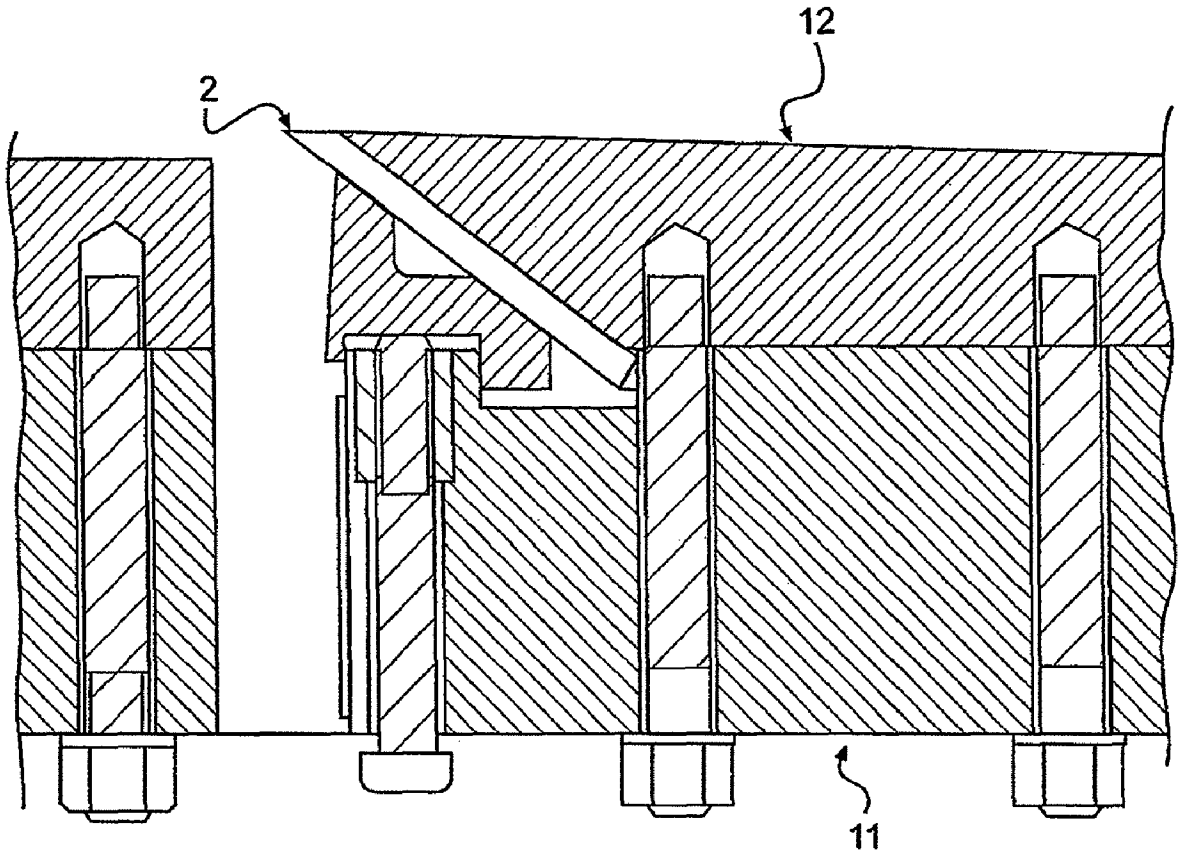
FIG. 1 Prior Art
FIG. 1 is a cut-out depiction of a ground knife blade holding assembly.
Figure 2:
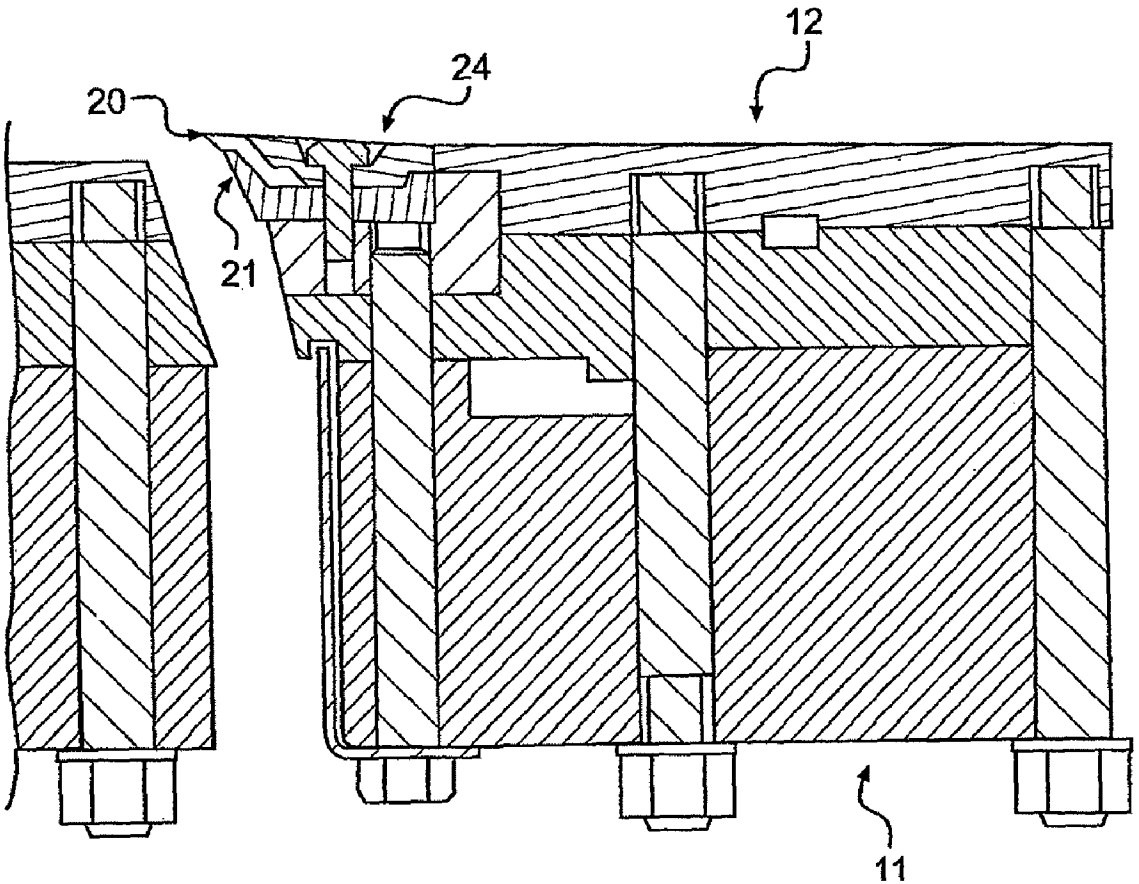
FIG. 2 Prior Art
FIG. 2 is a cut-out depiction of a disposable knife blade holding assembly.
Figure 3:
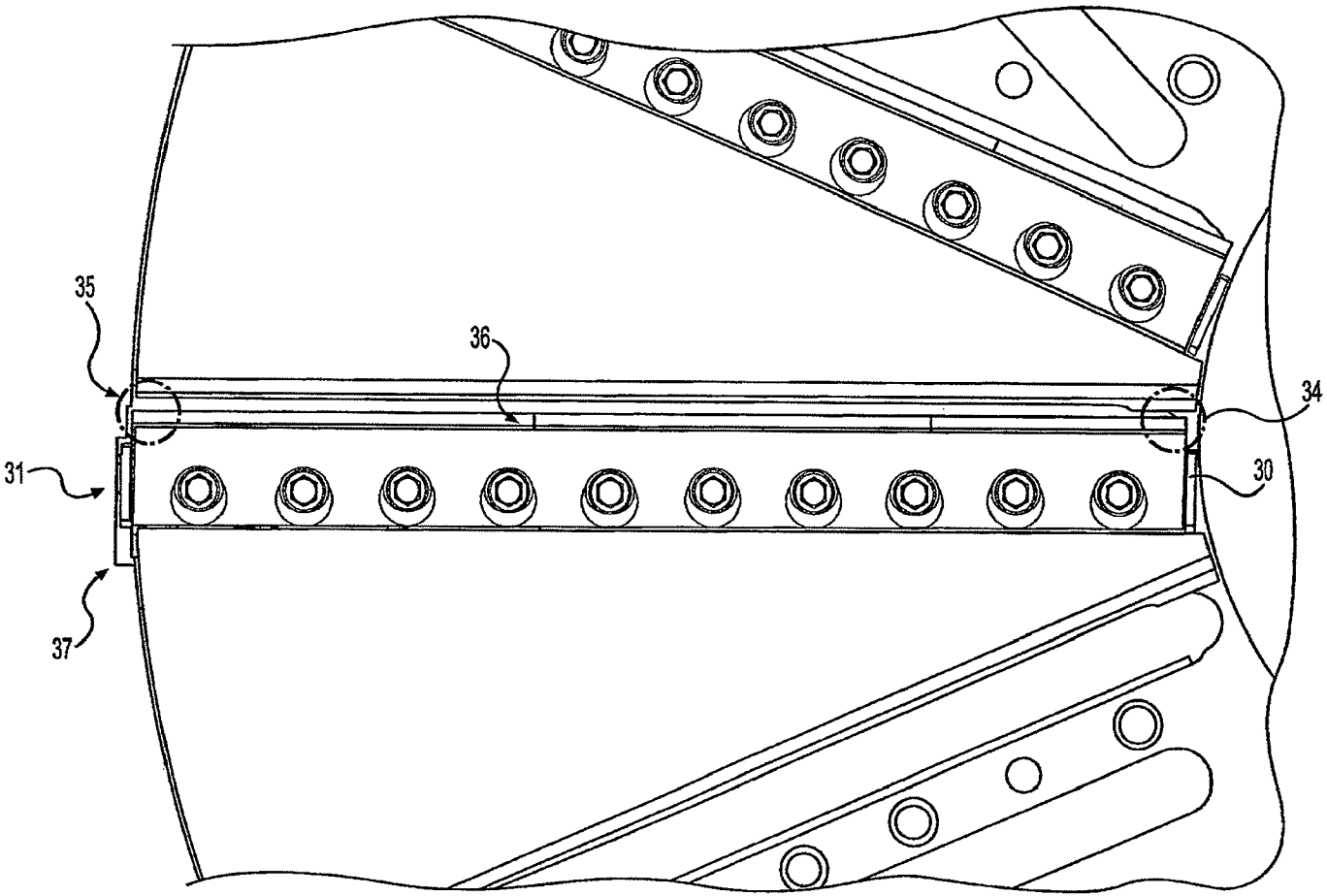
FIG. 3 Prior Art
FIG. 3 is an overhead depiction of a knife blade holding assembly with traditional knife stops.
Figure 4:
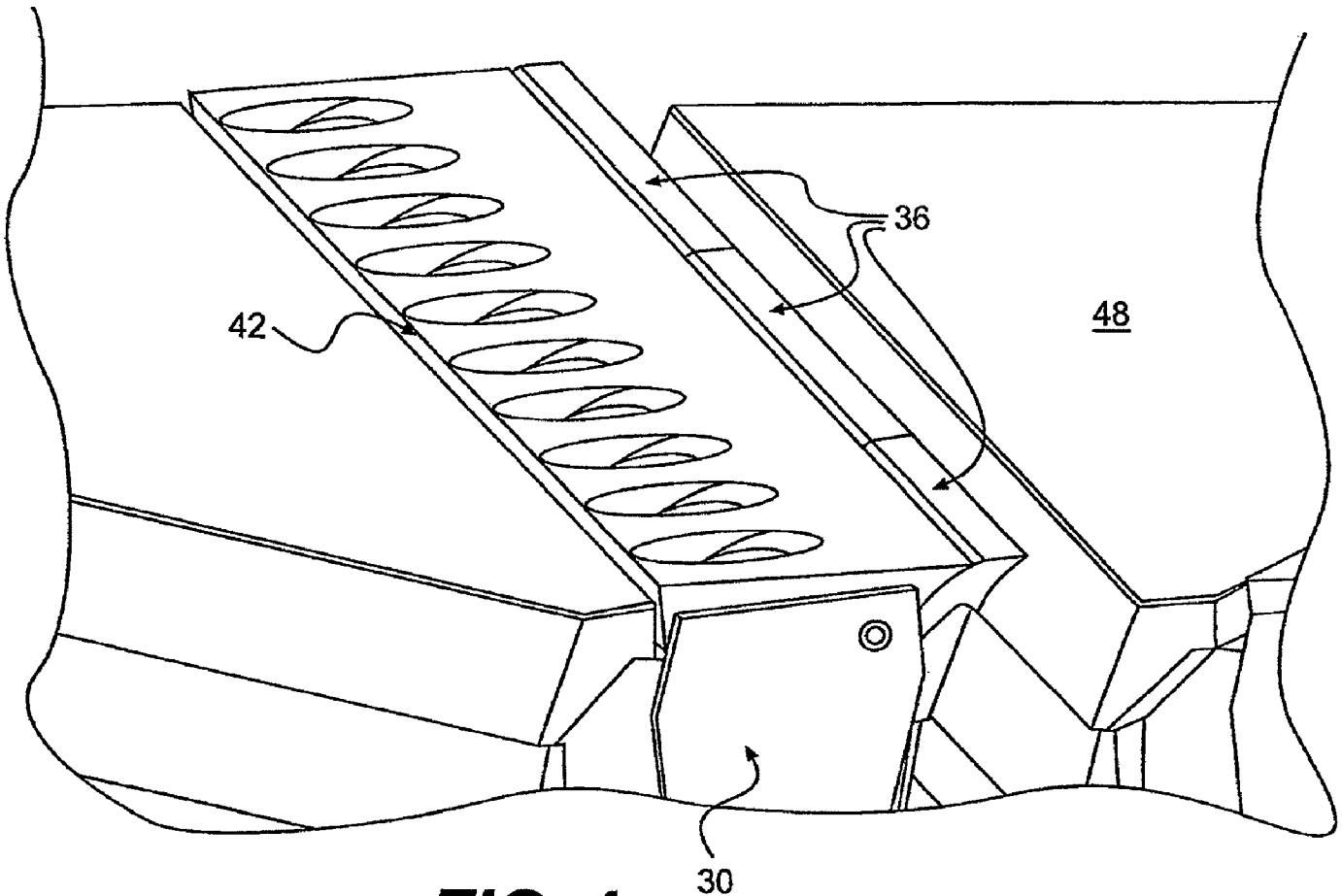
FIG. 4 Prior Art
FIG. 4 is a depiction of a knife blade holding assembly with a traditional knife stop.
Figure 5:
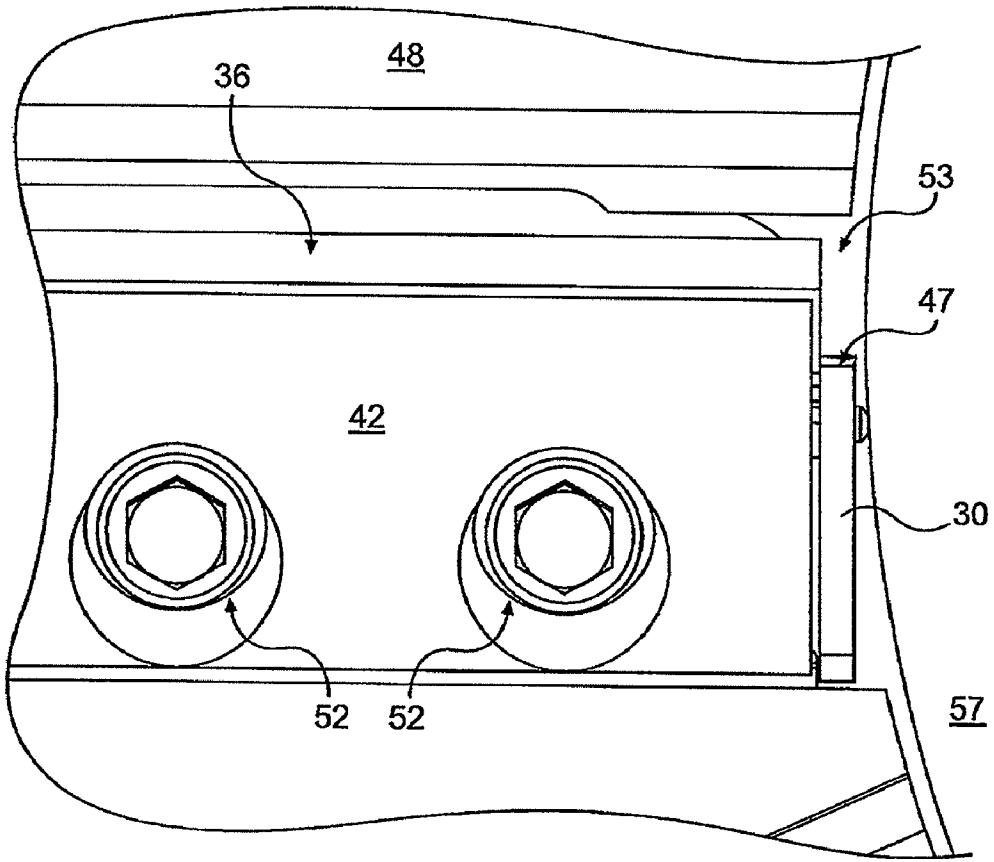
FIG. 5 Prior Art
FIG. 5 is a close up overhead depiction of the inner end portion of a knife blade holding assembly with a knife stop device.

Traditional knife stops differ in profile from the knife and do not have a cutting edge. This causes wood debris to accumulate in an area between the knife stop and the knife. The debris build up areas are shown in FIG. 3. When resetting the knives, this built up debris then needs to be removed, as the debris lowers the efficiency of the knife. The debris removal process is a time consuming process that adds to the time required to reset or replace the knives and increases the chipping or cutting device's downtime.

By matching the profile of the knife and having a sharp edge on the knife stop, the wood debris will no longer accumulate between the knife and the knife stop because there is no longer an extraneous surface that accumulates debris. The sharp edged knife stops facilitate the flow of debris in the same manner as the rest of the knife assembly. Whereas the traditional knife stops have an irregular surface that produces debris buildup, the sharp edged knife stop can be shaped so that its profile matches that of the rest of the knife holding assembly. The use of a sharp edged knife stop, therefore, limits debris accumulation and decreases machine downtime, as the significant amount of time spent on debris removal during blade operations is minimized or eliminated.

The exposed cutting area of a chipping device is not always fully utilized. Wood material of different shapes and sizes are fed into the machine at varying rates, resulting in different exposed knife areas being used unequally. Oftentimes the areas on the far inside and the far outside edges of the knife pocket are used less than the area in the middle of the knife pocket. In the present invention, the sharp edged knife stops can be located in the low use areas of the cutting plane.

Figure 10:
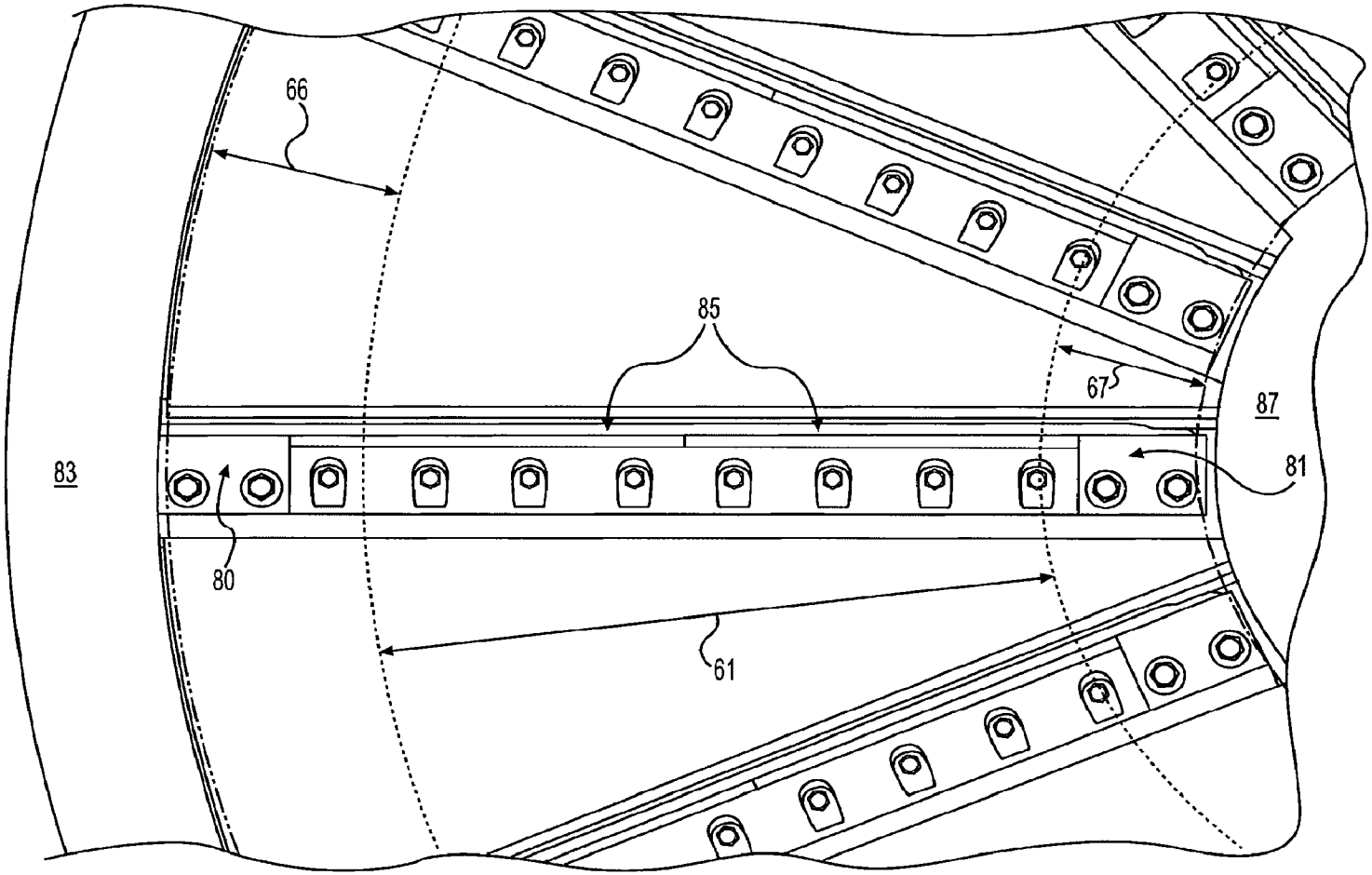
FIG. 10 is an overhead depiction of a knife blade holding assembly with sharp edged knife stops.

As shown in FIG. 10, the sharp edged knife stops 80 and 81 are located at the distal ends of the cutting plane. As such, the knife blades 85 are largely located in the high use area 61 of the cutting edge. The blades, therefore, are used more evenly, because only a small portion of the blades is located outside of the high use area 61. The blades, therefore, do not need to be interchanged frequently to ensure even use. In fact, it may be possible to eliminate the interchanging of the blades 85 entirely.

As mentioned above, better utilization of the knife edges can be accomplished by swapping the position of knives after they have been worn down. In practice it is difficult to optimally interchange the knife blades in order to maximize blade life. The concept of a sharp knife stop design will allow the knife stop to do the occasional cutting work in the less frequently used cutting areas, thus eliminating the minor wear on blade edges that normally would be positioned in these areas.

Figure 6:
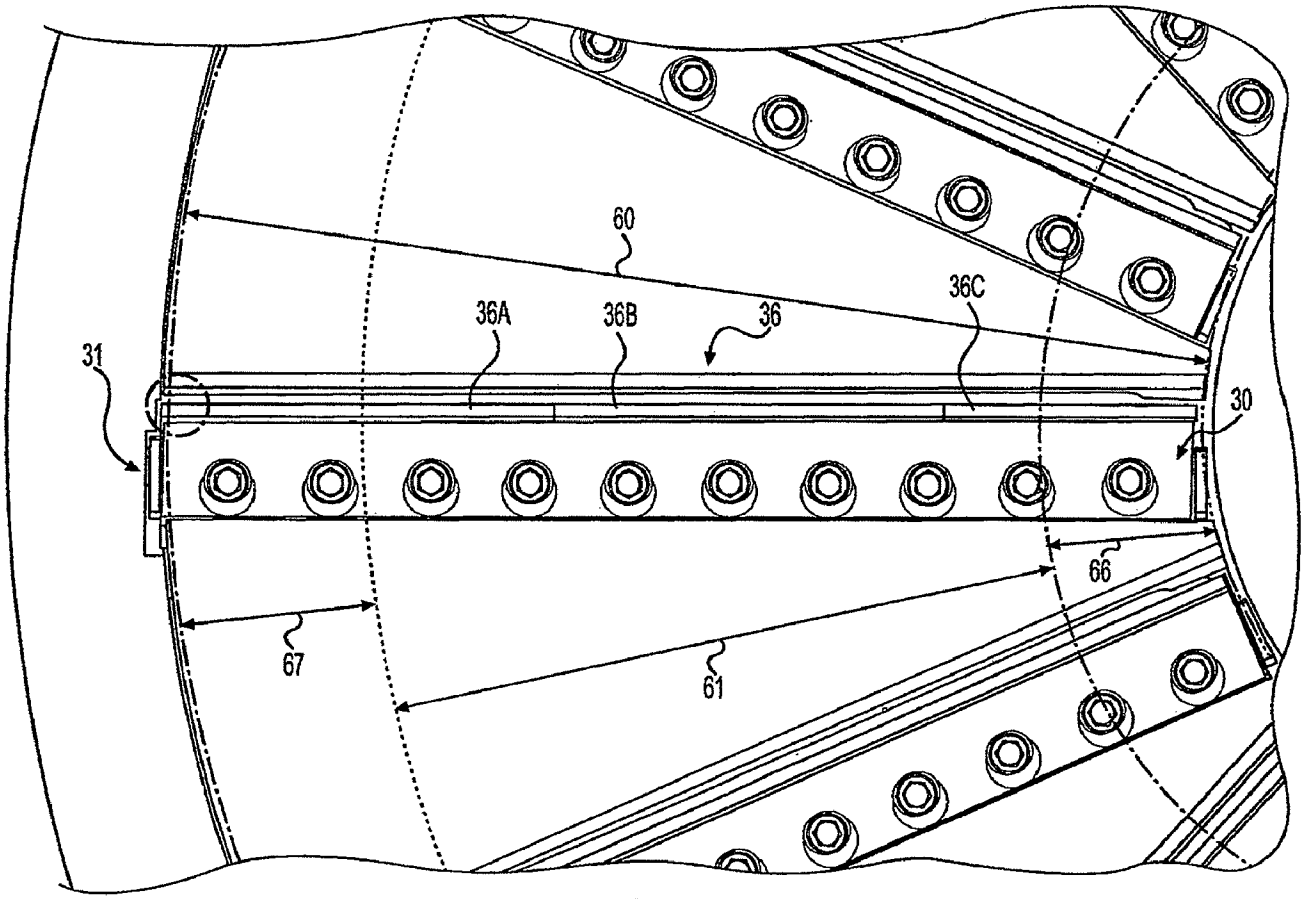
FIG. 6 Prior Art
FIG. 6 is an overhead depiction of a knife blade holding assembly with traditional knife stops in a retaining ring.
Figure 7:
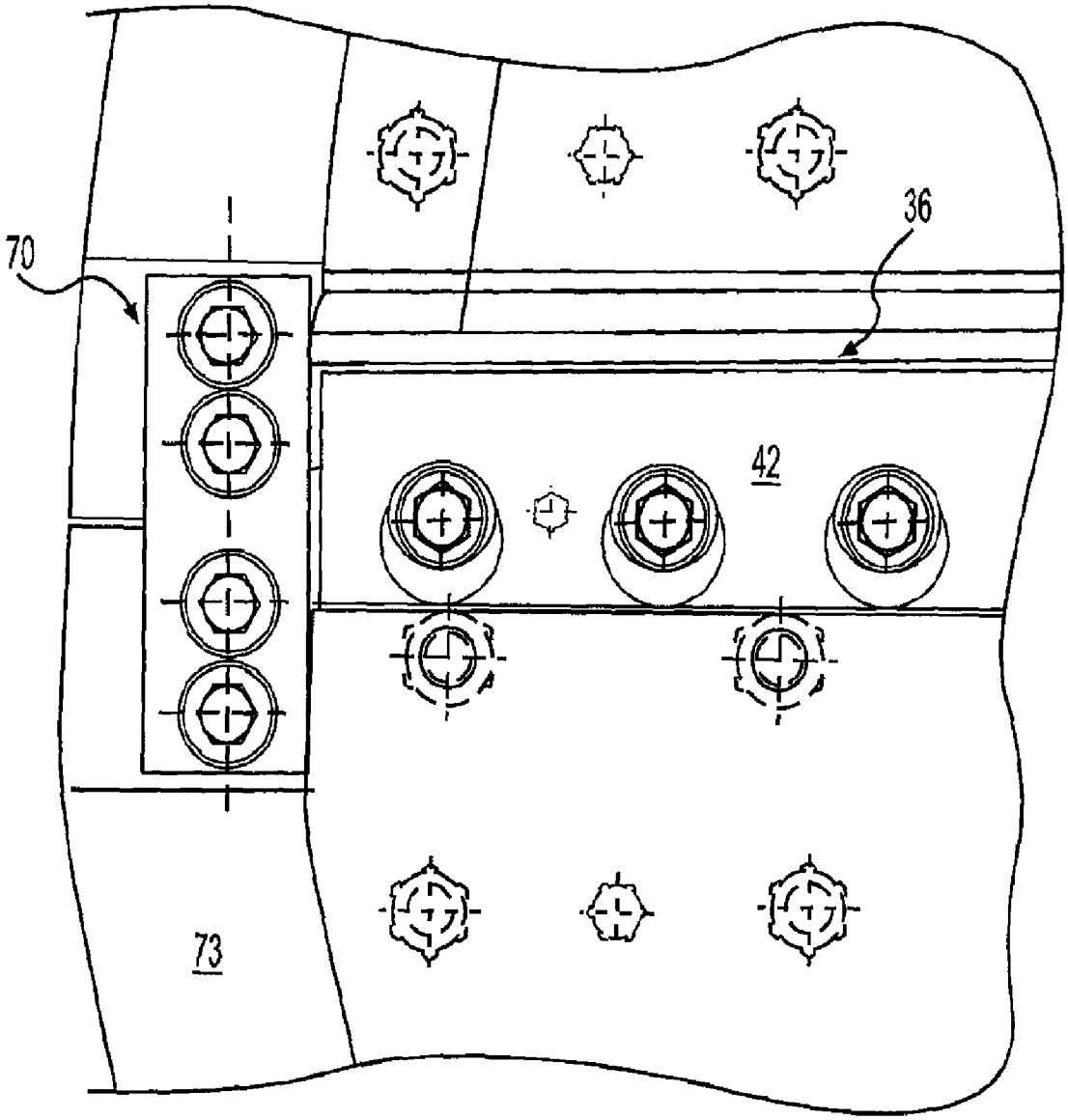
FIG. 7 is an overhead depiction of the outer end portion of a knife blade holding assembly with a knife block device.

The high and low use areas of the blade are illustrated with traditional knife stop and sharp edged knife stops in FIGS. 6 and 10, respectively. The sharp edged knife stops 80 and 81, as shown in FIG. 10, fill a substantial portion of the low use areas 66 and 67 of the knife. The cutting edge of the sharp edged knife stops are used less frequently and, therefore, the cutting edges of the sharp edged knife stops do not have to be sharpened or replaced as frequently as the knife blades.

While the foregoing embodiments of the present invention have been set forth in considerable detail for the purposes of making complete disclosure of the invention, it will be apparent to those skilled in the art that various modifications can be made to the knife, clamping assembly, and sharp edged knife stops without departing from the scope of the invention as defined in the claims. Some of these variations are discussed above and others will be apparent to those skilled in the art. For example, a non-reversible, single edged blade could be used for the knife wherein the knife has only one cutting edge on one side of the knife but no edge on the opposite side. Further, the sharp edged knife stop could be secured to a top plate. Still further, the sharp edged knife stop could be designed as an integral part of the knife clamp. In yet another variation, the sharp edged knife stop can be utilized along with a knife block device that is attached to the retaining ring, and the sharp edged knife stop directly abuts the knife block device.

The invention claimed is:

1. A knife holding assembly, including:

a knife blade having opposed top and bottom surfaces and opposite ends defining end surface between the top and bottom surface and a longitudinally extending cutting edge formed thereon;

a knife clamp for securing the knife blade; and a knife stop including, a cutting edge wherein the knife stop is located to engage one of said end surfaces of the knife and limits longitudinal movement of the knife blade relative to the knife clamp in the longitudinal extending direction of the cutting edge.

2. The knife holding assembly according to claim 1, wherein the cutting edge of the knife stop is longitudinally aligned with the cutting edge of the knife blade to form a substantially continuous cutting edge.

3. The knife holding assembly according to claim 1, further comprising a plurality of knife blades, wherein the knife stop prevents the plurality of knife blades from separating from one another in the longitudinal direction defined by the longitudinally extending cutting edges thereof.

4. The knife holding assembly according to claim 1, wherein the knife blade is a disposable knife blade.

5. A knife holding assembly, including:

a knife blade having a cutting edge;

a knife clamp for securing the knife blade;

a knife stop, wherein the knife stop includes a cutting edge and limits movement of the knife blade relative to the knife clamp; and a rotating base element, said knife blade being secured by the knife clamp on the rotating base element, and wherein the knife stop is secured to the rotating base element by at least one fastener.

6. The knife holding assembly according to claim 5, wherein the at least one knife stop fastener is secured to the rotating base element in a recess created in the knife stop.

7. A knife holding assembly, including:

a knife blade having a cutting edge;

a knife clamp for securing the knife blade;

a knife stop, wherein the knife stop includes a cutting edge and limits movement of the knife blade relative to the knife clamp; and a second knife stop including a cutting edge, wherein the second knife stop further limits movement of the knife blade relative to the knife clamp.

8. The knife holding assembly according to claim 7, further comprising first and second retaining rings; and first and second knife block devices, wherein the first knife block device is attached to the first retaining ring and directly abuts the knife stop and the second knife block device is attached to the second retaining ring and directly abuts the second knife stop.

9. A knife holding assembly, including a knife blade having a cutting edge;

a knife clamp for securing the knife blade;

a knife stop, wherein the knife stop includes a cutting edge and limits movement of the knife blade relative to the knife clamp;

a retaining ring; and a knife block device, wherein the knife block is attached to the retaining ring and directly abuts the knife stop.

10. A knife stop for use in a circular wood processing machine having a rotating member for rotating at least one knife blade having opposed top and bottom surfaces and opposite ends defining end surfaces between the top and bottom surfaces and a longitudinally extending cutting edge, said knife blade being adapted to be mounted on the rotating member such that its cutting edge extends in radial direction relative to the rotating member, wherein the knife stop engages one of said end surfaces of the knife to limit movement of the at least one knife blade in a radial direction of the rotating member, the knife stop including:

a sharp edge which forms part of a cutting edge along with the cutting edge of the at least one knife blade.

11. The knife stop according to claim 10, wherein the cutting edge of the knife stop is the same height above a plane of the rotating member as the cutting edge of the at least one knife blade.

12. The knife stop according to claim 10, further including a guiding portion for guiding debris towards a radially disposed opening in the rotating member.

13. A wood processing apparatus, comprising:

a rotating base member;

a knife blade which is radially disposed on the rotating member, said knife blade having opposed top and bottom surface and opposite ends defining end surfaces between the top and bottom surfaces and a longitudinally extending cutting edge extending radially on the rotating member;

a knife clamp for securing the knife blade to the rotating base member; and a knife stop engaging at least one of said end surfaces of the knife blade for limiting radial movement of the knife blade relative to the rotating base member, and said knife stop includes a cutting edge longitudinally adjacent to the cutting edge of the knife.

14. A wood processing apparatus, comprising:

a rotating base member;

a knife blade which is radially disposed on the rotating member;

a knife clamp for securing the knife blade to the rotating base member;

a knife stop disposed at an end of the knife blade for limiting radial movement of the knife blade relative to the rotating base member, said knife stop including a cutting edge; and a second knife stop including a cutting edge, wherein the second knife stop further limits radial movement of the knife blade relative to the rotating base member.

15. A wood processing apparatus, comprising:

a rotating base member;

a knife blade which is radially disposed on the rotating member;

a knife clamp for securing the knife blade to the rotating base member;

a knife stop disposed at an end of the knife blade for limiting radial movement of the knife blade relative to the rotating base member, said knife stop including a cutting edge; and at least one retaining ring surrounding the rotating member, wherein the knife stop is located at the end of the blade closest to the at least one retaining ring.

16. The wood processing apparatus according to claim 15, further comprising a knife block device, wherein the knife block is attached to the retaining ring and directly abuts the knife stop.

* * * * *